US008469492B2

(12) United States Patent
Lee et al.

(10) Patent No.: US 8,469,492 B2
(45) **Date of Patent: *Jun. 25, 2013**

(54) METHOD OF PRINTING DROPLET USING CAPILLARY ELECTRIC CHARGE CONCENTRATION

(75) Inventors: Beom-seok Lee, Yongin-si (KR); Jeong-gun Lee, Yongin-si (KR); In-seok Kang, Pohang-si (KR); Jin-seok Hong, Pohang-si (KR); Dustin Moon, Pohang-si (KR)

(73) Assignee: Samsung Electronics Co., Ltd. (KR)

( * ) Notice: Subject to any disclaimer, the term of this patent is extended or adjusted under 35 U.S.C. 154(b) by 634 days.

This patent is subject to a terminal disclaimer.

(21) Appl. No.: 12/620,856

(22) Filed: Nov. 18, 2009

(65) Prior Publication Data

US 2010/0060697 A1 Mar. 11, 2010

Related U.S. Application Data

(63) Continuation-in-part of application No. 11/746,299, filed on May 9, 2007, now Pat. No. 7,794,054.

(30) Foreign Application Priority Data

May 10, 2006 (KR) ..... 10-2006-0041964

(51) Int. Cl.
*B41J 2/06* (2006.01)

(52) U.S. Cl.
USPC ..... 347/55; 347/47

(58) Field of Classification Search
USPC ..... 347/20, 44, 47, 54, 55
See application file for complete search history.

(56) References Cited

U.S. PATENT DOCUMENTS

| | | | | |
|---|---|---|---|---|
| 7,794,054 | B2 * | 9/2010 | Lee et al. | 347/55 |
| 2003/0146757 | A1 | 8/2003 | Aguero et al. | |

FOREIGN PATENT DOCUMENTS

| | | |
|---|---|---|
| EP | 0 780 229 | 6/1997 |
| EP | 1 550 553 | 7/2005 |
| EP | 1 623 832 | 2/2006 |
| GB | 729842 | 5/1955 |
| KR | 10-0668343 | 1/2007 |
| KR | 100668343 B1 | 1/2007 |

OTHER PUBLICATIONS

European Search Report for European Application No. 06123329.2-2304 dated Jun. 3, 2008.

Jim Seok Hong and Beom-Seok Lee, et al., "Highly Uniform Pumpless Dispensing Method Using Electric Induction and Liquid Bridge Break-up," Topic No. 1.3 (Microfluidics), presented Nov. 3, 2009 at the MicroTAS 13th International Conference on Miniaturized Systems for Chemistry and Life Sciences (item T20A on p. 52 of MicroTAS Conference program submitted herewith).

European Office Action for Application No. 06 123 329.2-2304 dated Dec. 16, 2009.

* cited by examiner

*Primary Examiner* — Juanita D Jackson
(74) *Attorney, Agent, or Firm* — Cantor Colburn LLP

(57) ABSTRACT

A method of printing droplets using capillary electric charge concentration includes: providing a capillary nozzle comprising a back-end part and a front-end part disposed substantially opposite the back-end part; spacing a target member apart from the front-end part of the capillary nozzle at a predetermined distance; immersing the back-end part in a solution; and supplying a voltage to the solution. The back-end part transmits the solution to the front-end part.

12 Claims, 14 Drawing Sheets

METHOD OF PRINTING DROPLET USING CAPILLARY ELECTRIC CHARGE CONCENTRATION

This application is a continuation-in-part application of U.S. application Ser. No. 11/746,299, filed on May 9, 2007, which claims priority to Korean Patent Application No. 10-2006-0041964, filed on May 10, 2006, and all the benefits accruing therefrom under 35 U.S.C. §119, the contents of which in its entirety are herein incorporated by reference.

BACKGROUND OF THE INVENTION

1. Field of the Invention

The present invention relates to a method of printing droplets using capillary electric charge concentration, and more particularly, to a method of printing droplets using capillary electric charge concentration to stably supply a solution to be ejected to a nozzle using a capillary force.

2. Description of the Related Art

A droplet printing apparatus is used to eject very small droplet units of a solution on a substrate, wherein the substrate may be a variety of materials including microscope slides, biochips, paper, or other various materials. There are various droplet ejection methods. In an ink jet method, heat is supplied to a solution (ink) which is then ejected on a piece of paper or other material. However, this method is not appropriate when the characteristic of a solution to be ejected changes with heat. In particular, when a solution droplet includes a biomolecule such as a nucleic acid, a protein, a living cell, a virus, or bacteria a droplet printing apparatus wherein a solution can be ejected without heating is required.

An example of such an apparatus ejects picoliter-sized droplets using ultrasonic energy. In addition, a printing apparatus which ejects picoliter-sized droplets using electric charge concentration has been proposed in Korean Patent Application No. 2005-74496.

BRIEF SUMMARY OF THE INVENTION

The present invention provides an exemplary embodiment of a method of printing droplets which ejects small-sized droplets through a nozzle at short intervals while maintaining a constant droplet size and which can be further miniaturized.

The present invention also provides an exemplary embodiment of a method of printing droplets which substantially improves a degree of integration of biochips and the manufacturing effectiveness thereof when used to manufacture biochips In an exemplary embodiment of the present invention, a method of printing droplets using capillary electric charge concentration includes: providing a capillary nozzle comprising a back-end part and a front-end part disposed substantially opposite the back-end part; spacing a target member apart from the front-end part of the capillary nozzle at a predetermined distance; immersing the back-end part in the solution; and supplying a voltage to the solution. The back-end part transmits the solution to the front-end part.

In an alternative exemplary embodiment of the present invention, method of printing droplets includes: providing a capillary nozzle comprising a back-end part and a front-end part disposed substantially opposite the back-end part; spacing a target member apart from the front-end part of the capillary nozzle at a predetermined distance; immersing the back-end part in a solution; forming a liquid bridge between the target member and the front-end part by supplying a voltage to the solution; and moving the target member away from the front-end part at a predetermined velocity. The back-end part transmits the solution to the front-end part.

BRIEF DESCRIPTION OF THE DRAWINGS

The above and other aspects, features and advantages of the present invention will become more apparent by describing in more detail exemplary embodiments thereof with reference to the attached drawings in which.

Figure 1:
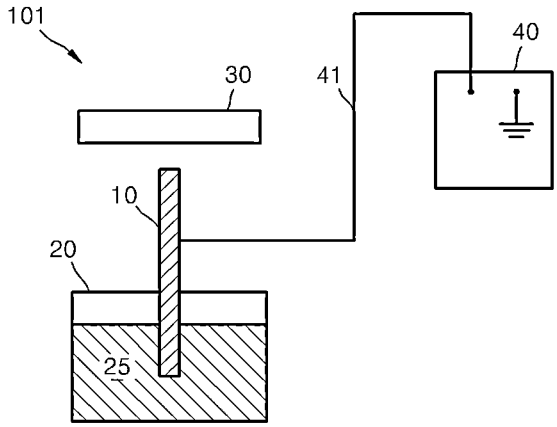
FIG. 1 is a schematic of an exemplary embodiment of a droplet printing apparatus according to the present invention.
Figure 2:
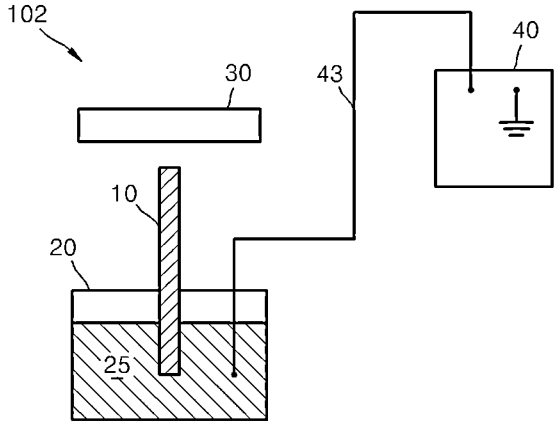
FIG. 2 is a schematic of another exemplary embodiment of a droplet printing apparatus according to the present invention, wherein a voltage is supplied to a solution through an electrode immersed in the solution.
Figure 3:
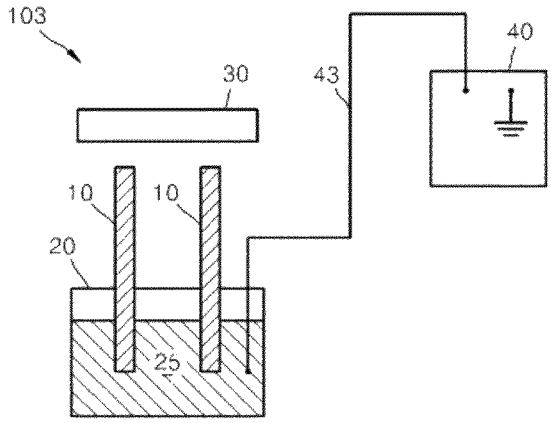
FIG. 3 is a schematic of another exemplary embodiment of a droplet printing apparatus according to the present invention wherein the apparatus includes two capillary nozzles placed in a reservoir.
Figure 11:
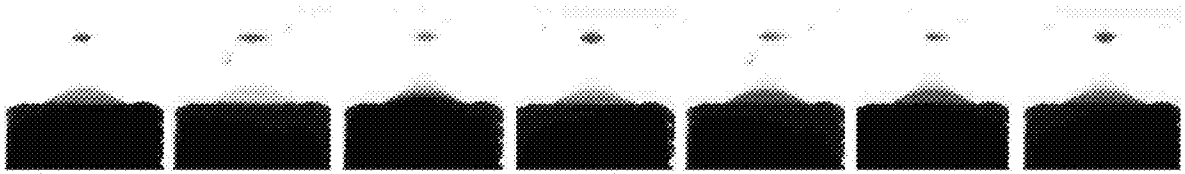
Figure 12:
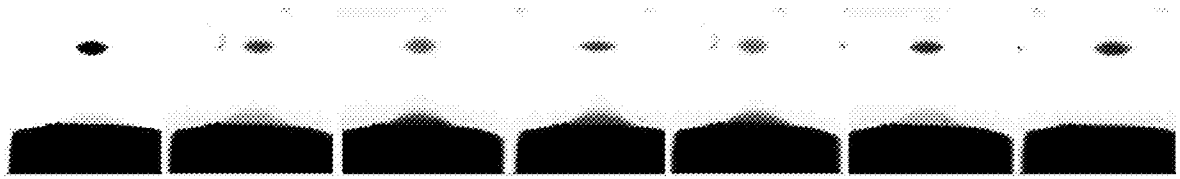
Figure 13:
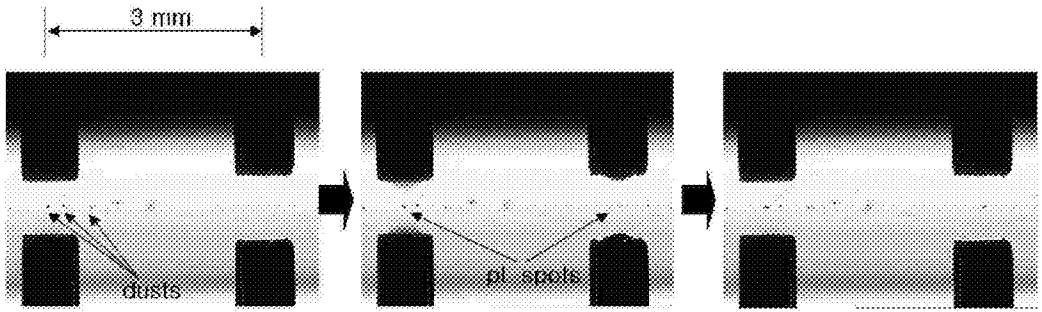
Figure 14:
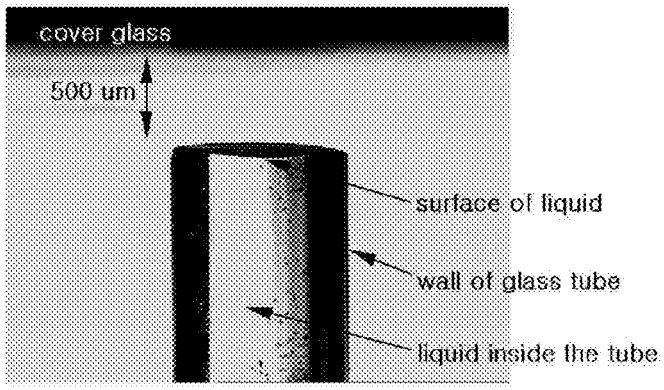
Figure 15:
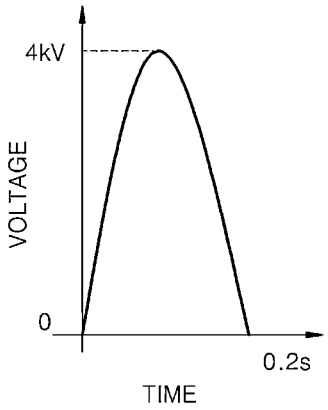

10A;

FIG. 11 is a series of photographs of droplets ejected using the exemplary embodiment of an apparatus of FIG. 1;

FIG. 12 is a series of photographs of droplets ejected using the exemplary embodiment of an apparatus of FIG. 2;

FIG. 13 is a series of photographs of a process of droplet ejection using the exemplary embodiment of an apparatus of FIG. 3;

FIG. 14 is a photograph showing a front-end part of a glass capillary nozzle in an exemplary embodiment of a droplet printing apparatus according to the present invention;

FIG. 15 is a graph showing a waveform of a voltage supplied by an open circuit type voltage supplier of the exemplary embodiment of an apparatus of FIG.

Figure 16:
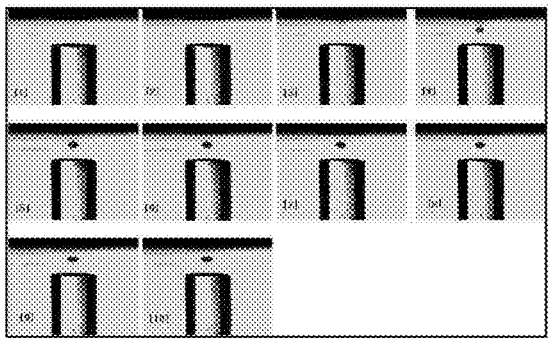
Figure 17:
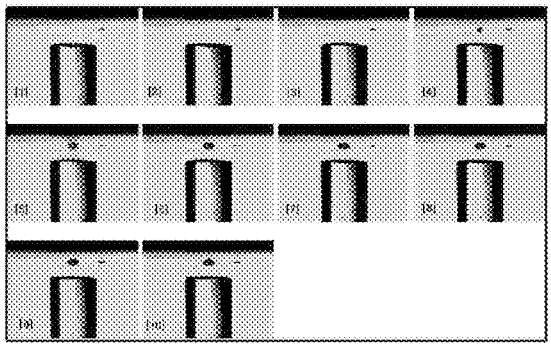
Figure 18:
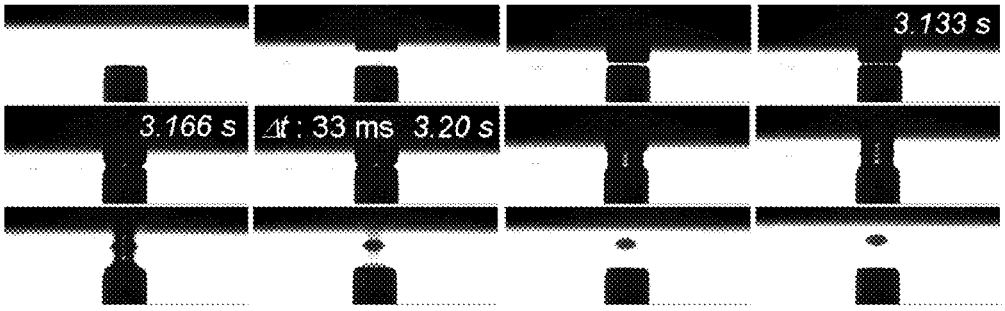
Figure 19:
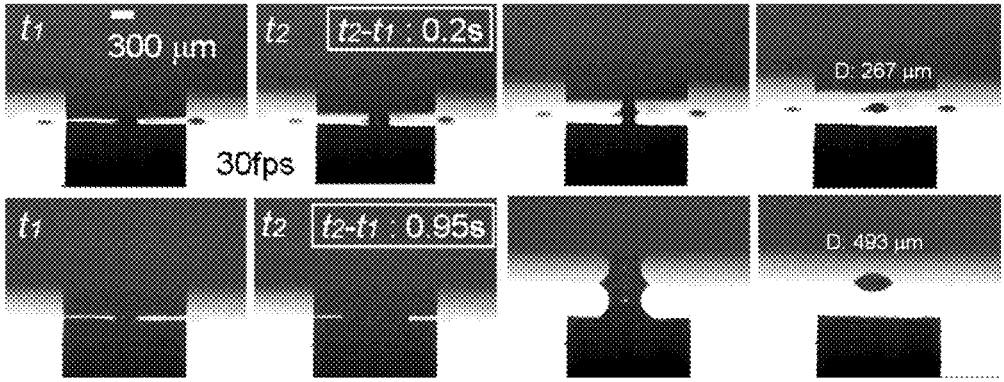
Figure 20A:
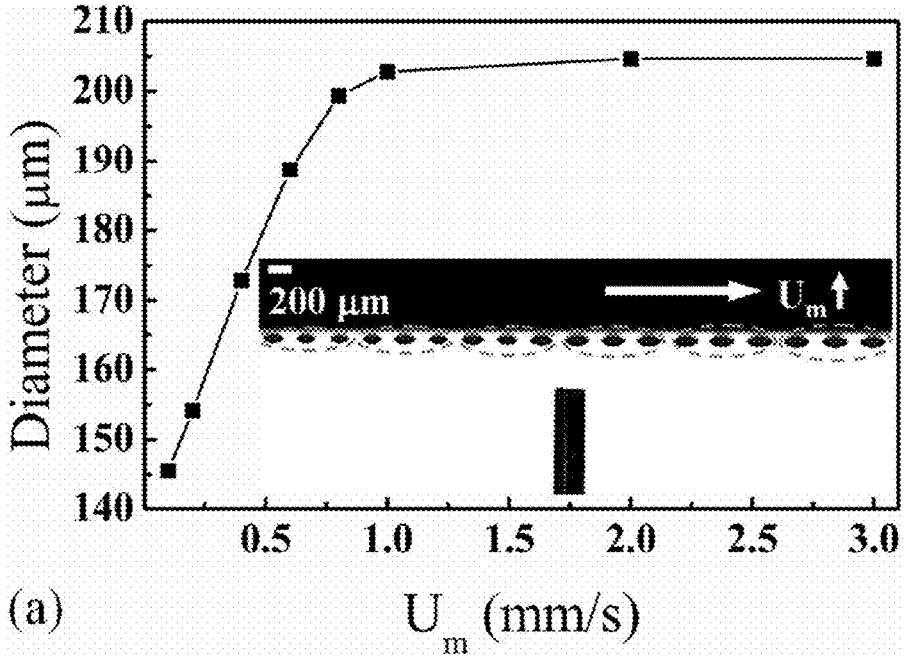
Figure 20B:
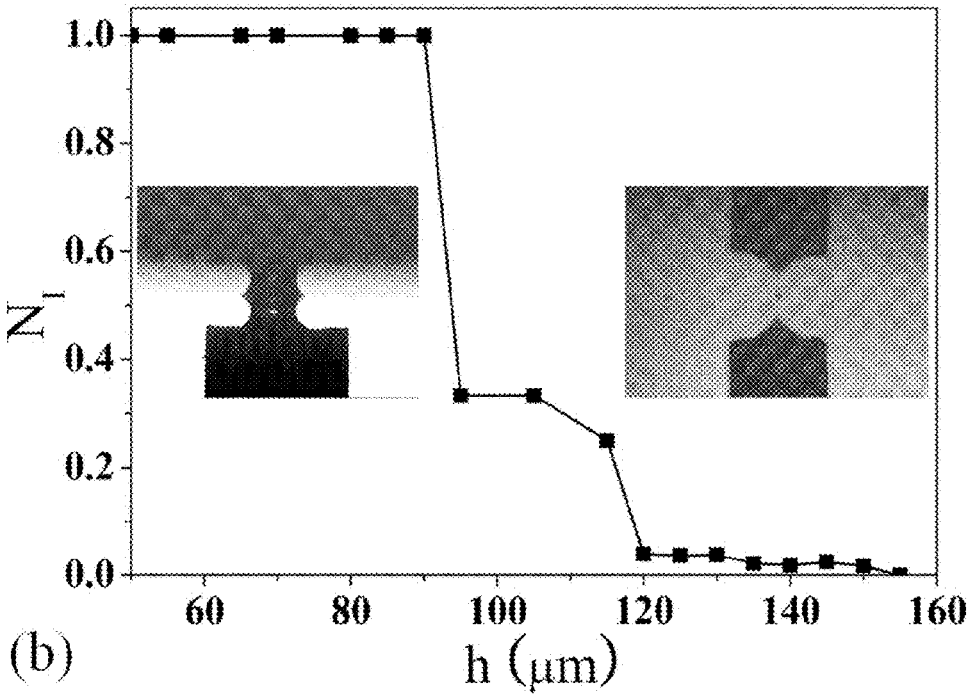
Figure 21A:
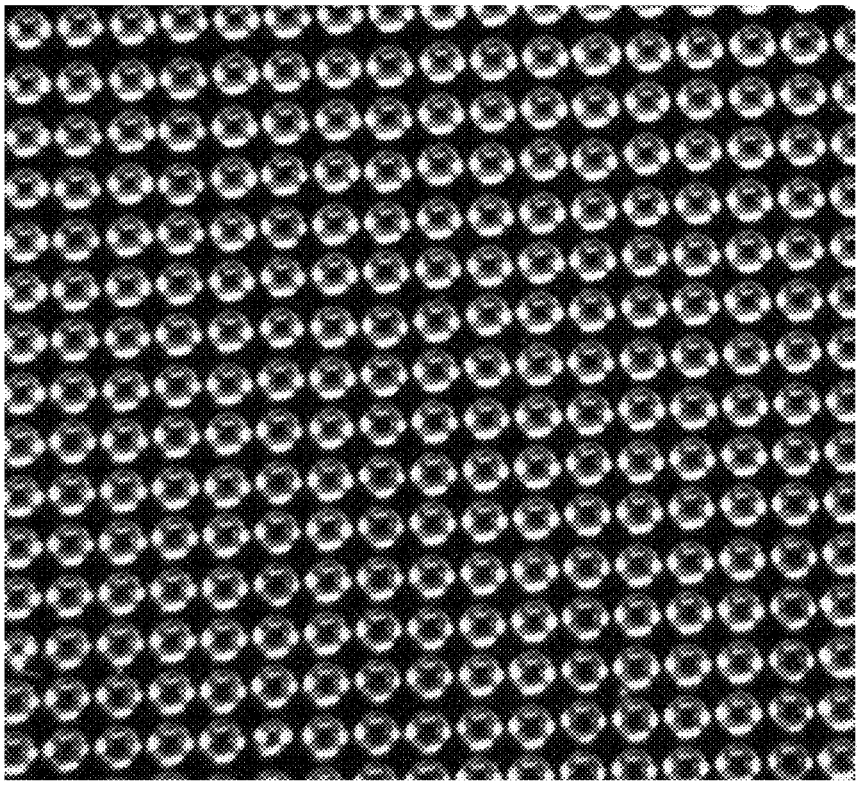
Figure 21B:
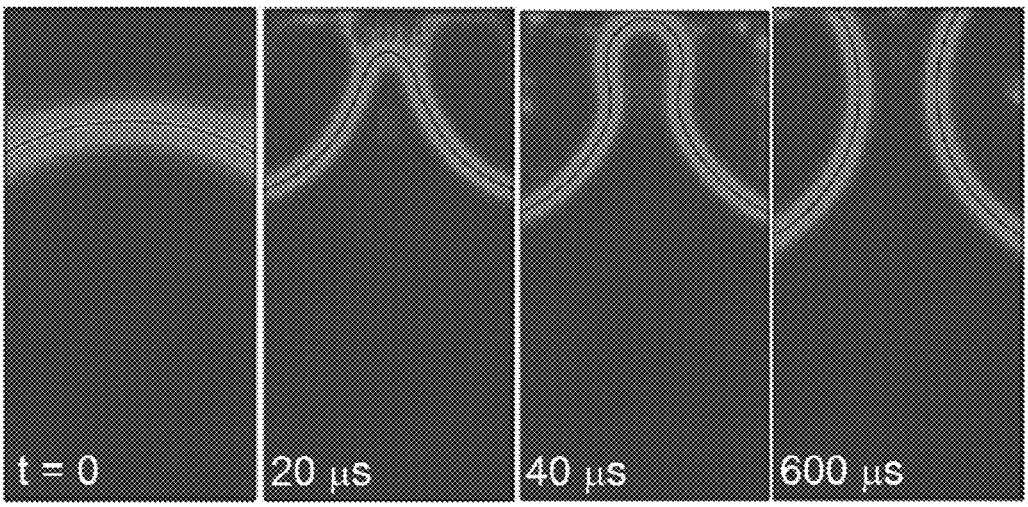

14;

FIG. 16 is a series of photographs showing an exemplary embodiment of a process of droplet ejection using the exemplary embodiment of a droplet printing apparatus of FIG. 14;

FIG. 17 is a series of photographs of an exemplary embodiment of a process of droplet ejection in close proximity to the dried droplets printed using the exemplary embodiment of an apparatus of FIG. 14;

FIG. 18 is a series of photographs showing an exemplary embodiment of a method of printing droplets according to the present invention;

FIG. 19 is a series of photographs showing effects of variations in incubation times in the method of FIG. 18;

FIG. 20A is a graph of droplet diameter versus plate velocity showing effects of variations in plate velocity in the method of FIG. 18;

FIG. 20B is a graph of a ratio of different dispensing types versus nozzle-to-plate distance in alternative exemplary embodiments of a method of printing droplets according to the present invention;

FIG. 21A is a dispensed array of DNA buffer solution droplets produced using an exemplary embodiment of a method of printing droplets according to the present invention; and FIG. 21B is a series of photographs showing liquid bridge formation in an exemplary embodiment of a method of printing droplets according to the present invention.

DETAILED DESCRIPTION OF THE INVENTION

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, the present invention will be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

FIG. 1 is a schematic of an exemplary embodiment of a droplet printing apparatus 101 according to the present invention.

In an exemplary embodiment of the present invention, the droplet printing apparatus 101 includes a reservoir 20 containing a solution 25, a capillary nozzle 10, one end of which is immersed in the solution 25 to transmit the solution 25 to an opposite end of the capillary nozzle 10 by a capillary force. In the current exemplary embodiment the back end of the capillary nozzle 10 is immersed in the solution 25 and the front end receives the solution 25 through a capillary action. The droplet printing apparatus 101 further includes a target member 30 spaced apart from the front-end part of the capillary nozzle 10 by a predetermined distance, and an open circuit type voltage supplier 40 which supplies a voltage to the solution 25. When an electric charge is concentrated on the surface of the solution 25 and is gathered on the capillary nozzle 10, an opposite electric charge is induced to the surface of the target member 30 which faces the capillary nozzle 10, and thus, a Coulomb force between the electric charges becomes stronger than the surface tension at the surface of the solution 25. Here, the predetermined distance refers to a distance from which a droplet can be ejected to the target member 30. Therefore, the predetermined distance varies according to the amplitude of a supplied voltage, an electrolyte concentration of the solution 25, the surface tension at the surface of the solution 25, and other physical constraints.

As illustrated in FIG. 1, the capillary nozzle 10 can be disposed in a substantially vertical direction in the reservoir 20 such that the front-end part of the capillary nozzle 10 is not immersed in the solution 25. Also, the target member 30 is disposed above the front-end part of the capillary nozzle 10. However, the capillary nozzle 10 can be also disposed slightly inclined or in a horizontal or vertical downward direction. When the capillary nozzle 10 is disposed in a vertical upward direction, the height of the capillary nozzle 10 exposed above the surface of the solution 25 can be determined to be in a range corresponding to a capillary force strong enough to lift the solution 25 in the capillary nozzle 10.

In one exemplary embodiment the capillary nozzle 10 can be formed of a conductive material such as a metal, exemplary embodiments of which include, gold, platinum, copper, or aluminum, or a conductive polymer. When the capillary nozzle 10 is formed of a conductive material, a voltage can be supplied to the solution 25 from the open circuit type voltage supplier 40 via a lead line 41 directly connected to the capillary nozzle 10.

In another exemplary embodiment, the capillary nozzle 10 can be formed of a non-conductive material, in which case the capillary nozzle 10 comprises a conductive material layer in an inner wall (such an exemplary embodiment will be discussed in greater detail with reference to FIGS. 5A and 5B). In such an exemplary embodiment, a voltage can also be supplied to the solution 25 from the open circuit type voltage supplier 40 via the lead line 41 directly connected to the conductive material layer in the inner wall of the capillary nozzle 10.

When the droplet printing apparatus 101 is used to manufacture a biochip or a DNA microarray, the target member 30 may be a composite substrate formed of at least one material or two materials selected from the group consisting of silicon, glass, and polymer, but the present invention is not limited thereto. Other materials can be used to form the target member 30 according to the intended use of the droplet printing apparatus 101. Droplets of the solution 25 ejected from the front-end part of the capillary nozzle 10 are attached to the surface of the target member 30. In one exemplary embodiment the surface of the target member 30 is coated with at least one material selected from the group consisting of an amine group, a carboxyl group, streptavidine, biotin, thiol, and Poly-L-Lysine, and thus, the adhesion of biomolecules included in the droplets to the target member 30 can be improved.

Moreover, in another exemplary embodiment the target member 30 may be a transparent substrate. If the target member 30 is transparent, droplets printed on the opposite side of the capillary nozzle 10 can be optically detected. The target member 30 can be also connected to a ground voltage.

The open circuit type voltage supplier 40 is electrically connected to the inner wall of the capillary nozzle 10. A voltage having a predetermined waveform can be supplied to the capillary nozzle 10 from the open circuit type voltage supplier 40 via the lead line 41. The voltage can be an AC voltage or a DC voltage and the predetermined waveform can be a sine wave, a triangular wave, a square wave, or a waveform obtained by overlapping at least two waveforms. The waveform and strength of the supplied voltage may vary according to the size of droplets and the physical characteristics of the solution 25. Thus, the solution 25 contained in the capillary nozzle 10 is electrically charged by the voltage supplied from the open circuit type voltage supplier 40.

An exemplary embodiment of an operating process of the exemplary embodiment of a droplet printing apparatus 101 according to the present invention will now be described.

The solution 25 contained in the reservoir 20 is transmitted by a capillary force from the back-end part of the capillary nozzle 10 immersed in the solution 25 to the front-end part of the capillary nozzle 10 exposed outside of the solution 25.

The solution 25 which reaches the front-end part of the capillary nozzle 10 and gathers thereon. The solution 25 does not overflow the front-end due to a surface tension which acts thereon. The shape of the solution 25 gathered on the capillary nozzle 10 has various forms according to a contact angle of the capillary nozzle 10 with the solution 25. When the voltage is supplied to the solution 25 by the open circuit type voltage supplier 40, an electric charge is concentrated on the surface of solution 25 which gathers on the front-end part of the capillary nozzle 10, while an opposite electric charge is induced on the surface of the target member 30, which is adjacent to the capillary nozzle 10. A van der Waals force, which occurs between the surface of the solution 25 on the front-end part of the capillary nozzle 10 and the target member 30, that is, a Coulomb force, is applied to the solution 25 in the nozzle 10. When the van der Waals force becomes stronger than the surface tension of the solution 25, droplets are ejected towards the target member 30. The ejected droplets have a picoliter or nanoliter-volume, and thus, gravitational forces are of minimal consequence. An operation principle of the droplet printing apparatus 101 using capillary electric charge concentration is briefly described herein following the detailed description in Korean Patent Application No. 2005-74496.

FIG. 2 is a schematic of another exemplary embodiment of a droplet printing apparatus 102 according to the present invention, wherein a voltage is supplied to a solution through an electrode (not shown) immersed in the solution 25.

The droplet printing apparatus 102 is substantially similar to the droplet printing apparatus 101 described above. One difference is that the open circuit type voltage supplier 40 supplies a voltage via a lead line 43 to the electrode immersed in a solution 25 contained in a reservoir 20. The electrode can be formed of various materials, and may also be an end part of the lead line 43. In one exemplary embodiment of the present invention, a capillary nozzle 10 may be formed of a conductive material or a non-conductive material.

FIG. 3 is a schematic of another exemplary embodiment of a droplet printing apparatus 103 according to the present invention wherein the apparatus includes two capillary nozzles 10 placed in a reservoir. Although only two capillary nozzles 10 are shown in FIG. 3, more than two capillary nozzles 10 may be used.

The droplet printing apparatus 103 is substantially similar to the droplet printing apparatus 102 described above. One difference is that two capillary nozzles 10 are disposed in the reservoir 20. Since, the open circuit type voltage supplier 40 supplies a voltage to a solution 25 contained in the reservoir 20 through the submerged electrode instead of directly supplying the voltage to the capillary nozzles 10, droplets can be ejected from a number of capillary nozzles 10 without wiring each of the capillary nozzles 10 to the voltage supplier 40.

Figure 4A:
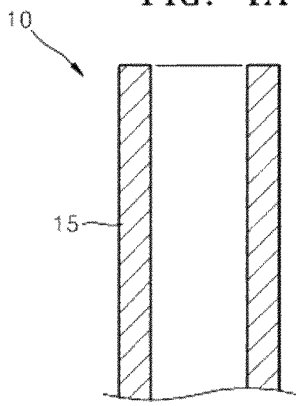
FIG. 4A is a cross-sectional view of an exemplary embodiment of the capillary nozzle of FIGS. 1 and 3 according to the present invention.
Figure 4B:
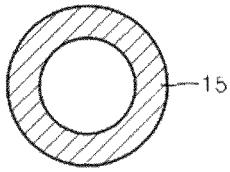
FIG. 4B is a top plan view of an exemplary embodiment of the capillary nozzle of FIGS. 1 and 3 according to the present invention.

FIG. 4A is a cross-sectional view, and FIG. 4B is a top plan view, of an exemplary embodiment of the capillary nozzle 10 according to the present invention. The capillary nozzle 10 may be an ordinary capillary cylinder but the present invention is not limited thereto. The capillary nozzle 10 can have any structure as long as it can transmit the solution 25 using a capillary force. Alternative exemplary structures include capillary nozzles with rectangular or ellipsoidal cross-sections, and nozzles which follow a curved path from the solution 25 to the target member 30. A wall 15 of the capillary nozzle 10 may be formed of a conductive material or a non-conductive material. The conductive material may be a metal which has an anti-corrosive property against the solution 25 to be ejected therethrough. Exemplary embodiments of the non-conductive material include glass or a plastic material.

Figure 5A:
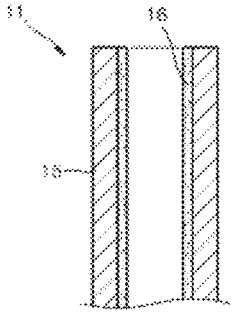
FIG. 5A is a cross-sectional view of an exemplary embodiment of a capillary nozzle having a conductive material layer included in an inner wall thereof, according to the present invention.
Figure 5B:
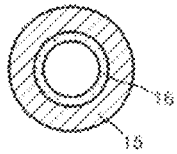
FIG. 5B is a top plan view of an exemplary embodiment of a capillary nozzle having a conductive material layer included in an inner wall thereof, according to the present invention.

FIG. 5A is a cross-sectional view, and FIG. 5B is a top plan view, of an exemplary embodiment of a capillary nozzle 11 having a conductive material layer 16 included in an inner wall thereof, according to the present invention. In one exemplary embodiment a wall 15 of the capillary nozzle 11 is formed of glass and the conductive material layer 16 may be an indium tin oxide ("ITO") layer. In such an exemplary embodiment, the conductive material layer 16 can be connected to the open circuit type voltage supplier 40 via the lead line.

Figure 6A:
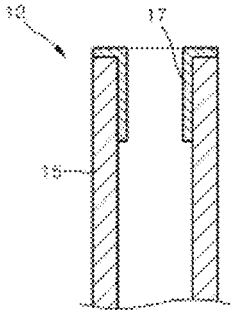
FIG. 6A is a cross-sectional view of an exemplary embodiment of a capillary nozzle having a coating layer included in a front-end part thereof.
Figure 6B:
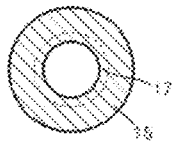
FIG. 6B a top plan view of an exemplary embodiment of a capillary nozzle having a coating layer included in a front-end part thereof.

FIG. 6A is a cross-sectional view, and FIG. 6B is a top plan view, of an exemplary embodiment of a capillary nozzle 12 having a coating layer 17 included on a front-end part thereof. The coating layer 17 may be further included along an inner surface of the front-end part of a wall 15 of the capillary nozzle 12. In the exemplary embodiment in which the solution 25 is an aqueous solution the coating layer 17 may be a hydrophobic coating layer. In such an exemplary embodiment the coating layer 17 may be formed of a material having low hydrophilicity with respect to the inner surface of the wall 15 of the front-end part of the capillary nozzle 12. Therefore, the coating layer 17 may increase or reduce a contact angle at the front-end part of the capillary nozzle 12 according to the configuration of the coating layer 17 and thus droplets can be formed in the front-end part of the capillary nozzle 12 with an appropriate size to be ejected.

Figure 7:
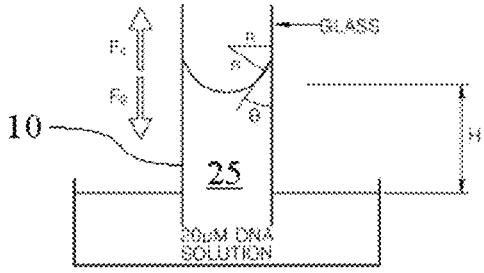
FIG. 7 is a schematic view of a transportation principle due to a capillary force in a capillary nozzle.

FIG. 7 is a schematic view of a transportation principle due to a capillary force in a capillary nozzle. A gravitational force (Fg) and a capillary force (Fc) act upon the solution 25 in the capillary nozzle 10. When the capillary nozzle is disposed in a substantially vertical position, the gravitational force (Fg) and capillary force (Fc) reach an equilibrium at a predetermined height (H). The height (H) is the maximum height at which the solution can be transmitted using only the capillary force (Fc). The height (H) of the capillary nozzle of the exemplary embodiment of a droplet printing apparatus according to the present invention is lower than the maximum height of the capillary nozzle 10 so that when droplets are ejected from the front-end part of the capillary nozzle the amount of solution corresponding to the volume of the droplets ejected can be immediately and stably replaced by additional solution 25. Since the solution 25 is supplied to the front-end part of the capillary nozzle 10 via the capillary force (Fc), the surface of the solution, immediately after the droplets are ejected, can be stabilized promptly and thus, the repeatability of the droplet printing apparatus can be greatly improved.

If the inner radius, a contact angle of the solution with the inner wall, the surface tension per the unit length, and the density of the solution are designated R, $\theta$, $\gamma$, and $\rho$, respectively, the maximum height H of the solution in the capillary nozzle where the gravitational force Fg and the capillary forces Fc are in equilibrium is $H=2\gamma \cos \theta/\rho g R$ (g is the gravitational acceleration at the Earth's surface).

For example, in a deoxyribonucleic acid ("DNA") solution having a concentration of 20 μM ($\gamma$=58.2 dyn/cm$^2$, $\theta$=40°, $\rho$=1.01 g/cm$^2$), when the inner radius R of the capillary nozzles is 0.0115 cm, H is approximately 7.4 cm. Therefore, if the height of the capillary nozzles measured from the surface of the solution is equal to or less than 7.4 cm, the solution can be supplied to the front-end part of the capillary nozzles.

Figure 8:
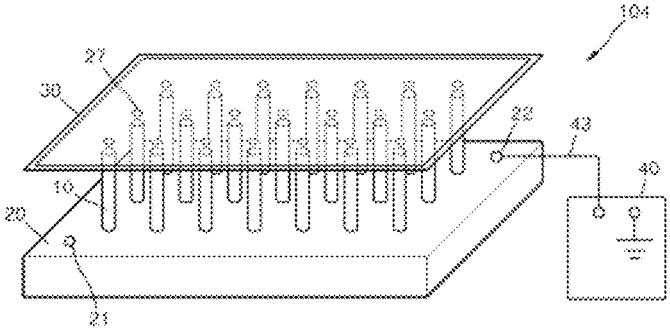
FIG. 8 is a front perspective view schematically illustrating an exemplary embodiment of a droplet printing apparatus having a plurality of capillary nozzles disposed in a reservoir according to the present invention.

FIG. 8 is a front perspective view schematically illustrating an exemplary embodiment of a droplet printing apparatus 104 having a plurality of capillary nozzles 10 disposed in one reservoir 20 according to the present invention. The capillary nozzles 10 can be disposed in any desired pattern in the reservoir 20. According to the arrangement of the capillary nozzles 10, droplets 27 are ejected from the capillary nozzles 10 and are subsequently seated on the target member 30 to form a regular pattern. The reservoir 20 includes an inlet hole 21 and an outlet hole 22, for respectively receiving and discharging a solution, and a lead line 43 connected to an open circuit type voltage supplier 40 can be electrically connected to the solution contained in the reservoir 20. In one exemplary embodiment the voltage supplier 40 is electrically connected to the solution contained in the reservoir 20 through the outlet hole 22. In more detail, the lead line 43 can be connected to an electrode (not illustrated) immersed in the solution contained in the reservoir 20. Similarly to the exemplary embodiment of an electrode described above with reference to FIG. 2, the exemplary embodiment of an electrode can be formed of any materials having an anti-corrosive property against the solution 25. In addition, in one exemplary embodiment in order to uniformly eject the droplets 27 from the capillary nozzles 10, distances between the electrode and the front-end part of each of the capillary nozzles 10 should be equal to one another. In one exemplary embodiment the capillary nozzles 10 can be also formed of insulating materials. In such an exemplary embodiment, an electrical interaction between the capillary nozzles 10 is decreased and thus, integration of the capillary nozzles is possible.

Figure 9:
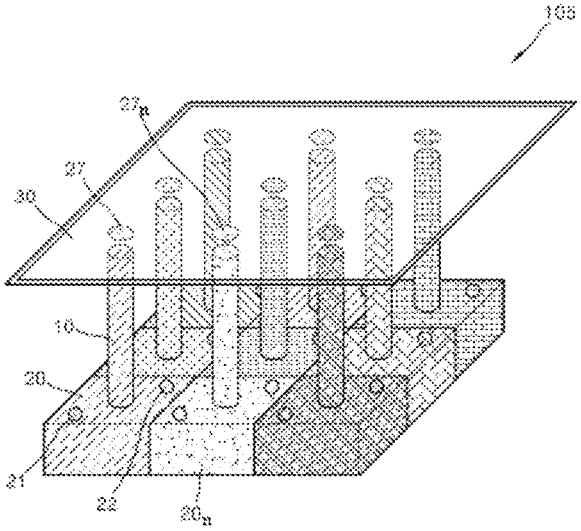
FIG. 9 is a front perspective view schematically illustrating an exemplary embodiment of a droplet printing apparatus including a plurality of printing modules according to the present invention.

FIG. 9 is a front perspective view schematically illustrating an exemplary embodiment of a droplet printing apparatus 105 including a plurality of printing modules according to the present invention. The droplet printing modules are arranged substantially two-dimensionally. The exemplary embodiment of a droplet printing apparatus 105 may contain a plurality of printing modules $p_1, p_2, \ldots, p_{n-1}$, and $p_n$. Droplets $\mathbf{27}_1, \mathbf{27}_2, \ldots, \mathbf{27}_{n-1}$, and $\mathbf{27}_n$, corresponding to the printing modules $p_1, p_2, \ldots, p_{n-1}$, and $p_n$, respectively, are ejected from each of the droplet printing modules on a target member 30 in a predetermined pattern. Each of the droplet printing modules includes a reservoir 20 through $\mathbf{20}_n$, respectively, containing a solution to be ejected, and a capillary nozzle 10, a back-end part of which is immersed in the solution 25 through $\mathbf{25}_n$ contained in the reservoir 20 or 20', a front-end part of which is spaced apart from the target member 30 at a predetermined distance, wherein the back-end part transmits the solution 20 through $\mathbf{20}_n$ to the front-end part of the capillary nozzle 10 via a capillary force, and an open circuit type voltage supplier (not illustrated) which supplies a voltage to the solution. In one exemplary embodiment the reservoirs 20 through $\mathbf{20}_n$ may contain different kinds of solutions or solutions of different concentrations. In this case, the composition of the droplets $27_1$, $27_2$, . . . , $27_{n-1}$, and $27_n$ may differ.

In one exemplary embodiment each of the reservoirs 20 through $20_n$ have an inlet hole 21 and an outlet hole 22. The open circuit type voltage supplier (not illustrated) may supply a voltage through an inner wall of the capillary nozzle 10 as in the exemplary embodiment of a droplet printing apparatus 101 of FIG. 1 or through an electrode (not illustrated) immersed in the solution contained in the reservoir 20 as in the exemplary embodiment of a droplet printing apparatus 102 of FIG. 2.

Figure 10A:
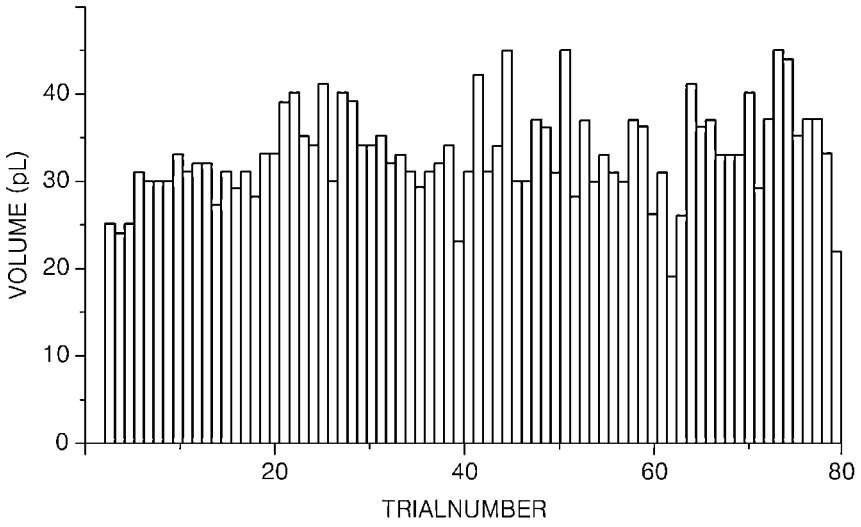
FIG. 10A is a graph showing a volume of droplets ejected using the exemplary embodiment of an apparatus of FIG. 1 having a stainless steel capillary nozzle.

FIG. 10A is a graph showing a volume of droplets ejected using the exemplary embodiment of an apparatus of FIG. 1 having a stainless steel capillary nozzle. The exemplary embodiment of a droplet printing apparatus used in the experiment to produce the graph includes capillary nozzles formed of stainless steel and a target member formed of a glass. The distance between the front-end part of the capillary nozzles 10 and the target member 30 is 200 μm and a voltage is supplied at an interval of 3.5 seconds and droplet ejection is repeatedly performed 80 times. As indicated in FIG. 10A, the average volume is 33 μL.

Figure 10B:
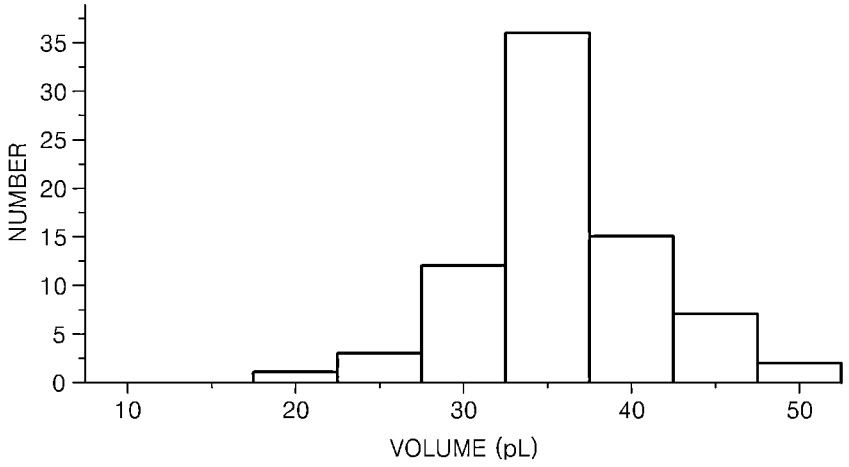
FIG. 10B is a graph showing a distribution chart of the droplet volume of FIG.

FIG. 10B is a graph showing a distribution chart of the droplet volumes of FIG. 10A. As shown in FIG. 10B, when droplet ejection is performed repeatedly 80 times, the average volume of the droplet is 33 μl and the standard deviation is 5.3, which mean an ejection reliability of 95%.

FIG. 11 is a series of photographs of droplets ejected using the exemplary embodiment of an apparatus of FIG. 1.

Referring to FIG. 11, a droplet is ejected 7 times at a 3 second interval using the exemplary embodiment of an apparatus used in the experiment described with respect to FIG. 10A. The open circuit type voltage supplier 40 is directly connected to the capillary nozzle 10 to supply the voltage. The lower parts of the photographs show the front-end part of the capillary nozzle 10 and a convex surface at the front-end part of the capillary nozzle 10 is the surface of the solution 25. The upper part of the photographs show a target member 30 formed of glass and each droplet is attached to the bottom surface of the target member 30. As shown in the photographs, the droplets have regular sizes.

FIG. 12 is a series of photographs of droplets ejected using the exemplary apparatus of FIG. 2.

Unlike the experiment shown in FIG. 11, the open circuit type voltage supplier 40 supplies the voltage through an electrode 10 immersed in the solution 25 contained in the reservoir 20. In this case, the volume of the droplet is bigger than in FIG. 11. However, after droplet ejections are repeatedly performed, the volumes of the droplets become more regular. FIG. 13 is a series of photographs of a process of droplet ejection using the exemplary embodiment of an apparatus of FIG. 3. The lower parts of the photograph show the capillary nozzle 10 and the upper parts of the photograph show a reflection of the capillary nozzle 10 on the glass substrate 30. In this exemplary embodiment two capillary nozzles 10 are disposed at an interval of about 3 mm. After the voltage is supplied to the electrode immersed in the solution 25, picoliter sized droplets are ejected at substantially the same time. When the capillary nozzles 10 are formed of a conductive material and the voltage is directly supplied thereto unwanted noise appears between adjacent capillary nozzles and thus, there is a limitation of integrating the capillary nozzles 10. However, when the voltage is supplied to the solution 25 contained in the reservoir as in FIG. 13, a plurality of capillary nozzles 10 can be disposed at short intervals of about 3 mm or less.

FIGS. 14 through 17 refer to experiments performed using an exemplary embodiment of a droplet printing apparatus having the structure according to the exemplary embodiment of FIG. 2 and the capillary nozzles 10 are formed of glass.

FIG. 14 is a photograph showing a front-end part of a glass capillary nozzle 10 in an exemplary embodiment of a droplet printing apparatus according to the present invention. The external diameter and the inside diameter of the glass capillary nozzle are about 1.5 mm and about 0.84 mm, respectively. Also, the height from the surface of the solution to the front-end part of the capillary nozzle is about 2.57 mm. As illustrated in FIG. 14, the distance between the front-end part of the capillary nozzle 10 and the target member is about 500 μm.

FIG. 15 is a graph showing a waveform of a voltage supplied by an open circuit type voltage supplier of the exemplary embodiment of a droplet printing apparatus described with respect to FIG. 14. The voltage waveform is a half cycle sine wave as shown in FIG. 15. The maximum voltage is about 4 kV. However, the waveform illustrated in FIG. 15 is but one exemplary embodiment and in alternative exemplary embodiments the open circuit type voltage supplier can supply voltages having various types of waveforms such as a one cycle sine wave, a square wave, a saw wave, and various combinations thereof. The size of the droplet ejected can be controlled by adjusting the voltage, size, and frequency of the waveform. When a sine waveform voltage is supplied, the volume of the droplet reduces when the frequency increases and vice versa.

The frequency of the voltage supplied can be in the range of about 1 kHz through about 10 kHz as necessary.

FIG. 16 is a series of photographs of an exemplary embodiment of a process of droplet ejection using the exemplary embodiment of a droplet printing apparatus described with respect to FIG. 14. The photographs were taken every 1/30 of a second. As shown in the photographs, a droplet is ejected just before taking the photograph [3]. The capillary nozzle 10 is formed of a transparent glass, and thus, a minute movement of the surface of the solution at the front-end part of the capillary nozzle can be observed.

The concave surface of water in the photographs [1] and [2] changes to a convex shape in the photographs [3] and [4] when a droplet is ejected and then, returns to a concave shape as illustrated in the subsequent photographs. In such an exemplary embodiment of the droplet printing process, 26 nl of solution is ejected and the liquid surface of the photograph [10] returns to a default state as in the photograph [1] similar to the state where a droplet has not yet been ejected.

FIG. 17 is a series of photographs of an exemplary embodiment of a process of droplet ejection in close proximity to the dried droplets printed using the exemplary embodiment of an apparatus of FIG. 14. As in FIG. 16, the photographs were taken every 1/30 of a second. FIG. 17 shows a process of ejecting a new droplet where the new droplets are disposed about 1 mm away from the dried droplets from the experiment of FIG. 16. Here, droplets are normally ejected without being affected by the droplets already placed on the target member 30. Such process can improve a degree of integration when manufacturing biochips such as a DNA chip.

In an alternative exemplary embodiment, a method of printing droplets, e.g., a method of dispensing droplets onto a plate, is provided. In an exemplary embodiment, droplet diameter is a function of nozzle-to-plate distance and a velocity of the top plate. Accordingly, droplet diameter is determined in an exemplary embodiment by controlling the nozzle-to-plate distance and/or the velocity of the top plate. As a result, droplet diameter is modified without requiring changing nozzles. More specifically, an exemplary embodiment provides a dispensing drop-on-demand ("DOD") method using an electric field with an inverse geometry and includes two stages: liquid bridge formation by electric induction, and break-up of the liquid bridge by motion of a top plate, e.g., the target member 30 relative to a bottom nozzle, e.g., the capillary nozzle 10, described in greater detail above.

More specifically and referring again to FIGS. 1-3 and 8-9, a method of printing droplets 27 using capillary electric charge concentration includes providing a capillary nozzle 10 comprising a back-end part and a front-end part disposed substantially opposite the back-end part. The method further includes spacing a target member 30 apart from the front-end part of the capillary nozzle 10 at a predetermined distance, immersing the back-end part in a solution 20, and supplying a voltage to the solution using the voltage supplier 40. The back-end part transmits the solution 20 to the front-end part of the capillary nozzle 10.

In an alternative exemplary embodiment, a method of printing droplets includes providing a capillary nozzle 10 including a back-end part and a front-end part disposed substantially opposite the back-end part. A target member 30, such as a glass substrate 30 or a silicon substrate 30, for example, is spaced apart from the front-end part of the capillary nozzle 10 at a predetermined distance. The back-end part is immersed in a solution 20 and the solution 20 is transmitted to the front-end part from the back-end part. A liquid bridge is formed between the target member 30 and the front-end part by supplying a sinusoidal voltage, such as an AC voltage, for example, to the solution 20. The target member 30 is moved away from the front-end part at a predetermined velocity, and a droplet is thereby formed on the target member 30 when the liquid bridge is broken.

Experiments were performed using methods according to exemplary embodiments described herein, and automatic capillary rise was shown to be exploited in droplet dispensing, thereby eliminating requirements for additional components, such as an external pump, for example, as will now be described in further detail with reference to FIGS. 18 through 21B. FIG. 18 is a series of photographs showing an exemplary embodiment of a method of printing droplets according to the present invention, FIG. 19 is a series of photographs showing effects of variations in incubation times in the method of FIG. 18, FIG. 20A is a graph of droplet diameter versus plate velocity showing effects of variations in plate velocity in the method of FIG. 18, FIG. 20B is a graph of a ratio of different dispensing types versus nozzle-to-plate distance in alternative exemplary embodiments of a method of printing droplets according to the present invention, FIG. 21A is a dispensed array of DNA buffer solution droplets produced using an exemplary embodiment of a method of printing droplets according to the present invention, and FIG. 21B is a series of photographs showing liquid bridge formation in an exemplary embodiment of a method of printing droplets according to the present invention.

Referring now to FIGS. 18 through 21B, deionized ("DI") water and a typical DNA buffer solution were used as working solutions with a stainless steel ("SUS") nozzle. Each buffer solution was mixed with glycerol (10-20 vol. %) to prevent evaporation. As shown in FIG. 18, a sinusoidal electric pulse is applied at time (t) of t=3.133 seconds (s), and the top plate starts to move up at t=3.166 s. An average size of the dispensed droplet (DI water+glycerol, 4:1 vol.) is 162.7 um (SUS, ID/OD: 260/460 um, $U_m$: 2 mm/s). As illustrated in FIG. 18, during the dispensing, the top plate approaches the nozzle close enough to form a liquid bridge. Then, the sinusoidal voltage pulse, supplied from the open circuit type voltage supplier 40 (FIG. 8), for example) is applied to the working solution. As a result, a liquid bridge between the nozzle and plate is formed by electric induction. After the formation of the liquid bridge, the top plate moves up, breaking the liquid bridge. As a result, a small droplet is dispensed on the bottom side of the top plate.

The size of the dispensed droplet is related to, among other things, the nozzle diameter. More specifically, FIG. 19 shows effects of variations in an inner ("ID") and an outer diameter ("OD") of the nozzle. A time from a moment at which the initial liquid bridge is formed until the plate starts to rise, e.g., an incubation time, also affects the droplet diameter, as does the velocity of the top plate, as well. More particularly, the effects of variations in top plate velocity (Um) are shown in FIGS. 20A and 20B, in which (ID/OD=127/1588 um and Um=2 mm/s). As can be seen from FIG. 20A, changes in the top plate velocity vary droplet diameters in sequential groups of three droplets dispensed each at a same respective velocity (nozzle: 33 G, ID/OD: 110/210 um).

In FIG. 20B, two different dispensing regimes (with respect to nozzle-to-plate distance) effect a ratio $N_l$ (where $N_l$ is a ratio of a number of left type dispensing drops to total number of dispensing drops). More particularly, FIG. 20B shows the effect of nozzle-to-plate distance (h), revealing the existence of a critical distance (hc) of hc~100 μm to form the liquid bridge in an exemplary embodiment. At distances greater than hc, Taylor-cone type jetting occurs, depending on the applied voltage, generating droplets having diameters of a few micrometers (corresponding to volumes on the order of femtoliters). Below hc, however, droplet size decreases with increasing h and duration time of the applied electric pulse.

Accordingly, in an exemplary embodiment, a size of the droplets is controlled based on the top plate velocity and/or nozzle-to-plate distance, and it is thereby possible to dispense different sizes of droplets without changing the nozzle.

As shown in FIG. 21A, an Experiment was performed, in which an array of DNA buffer solution droplets was dispensed using an exemplary embodiment of the method described above (nozzle: 26 G ID/OD: 260/460 μm, DNA buffer solution). More specifically, 19 by 24 arrays of DNA buffer solution droplets were successfully dispensed on a silicon (Si) wafer, confirming highly uniform distribution (with relative deviation of droplet size ~1.8%). As shown in FIG. 21B, evolution of an interface during the dispensing, is shown. More particularly, FIG. 21B, which illustrates interface evolution during the liquid bridge formation by an applied electric pulse (peak: 2 kV, duration time: 13.5 μs, surface tension: 20 mN/m) is shown.

Thus, in exemplary embodiments described herein, a dispensing method is successfully demonstrated in the Experiments described above. Using the method, nanoliter-to-femtoliter droplets are dispensed on demand with a single nozzle by controlling top plate velocity Um and nozzle-to-plate distance. This provides substantial benefits for diverse bio-applications such as DNA micro-array and other chips associated with bio-materials.

Thus, according to exemplary embodiments of the present invention, in the droplet printing apparatus, and a method thereof, using electric charge concentration can eject small sized droplets at short time intervals, the droplets having a constant size. Also, the apparatus can be miniaturized and be operated only with a voltage supplier without using other pressure application equipment. Thus, the apparatus can be easily transported and installation thereof is easy.

Moreover, when the droplet printing apparatus according to the present invention is used to manufacture biochips according to the exemplary embodiments described herein, an integration degree and manufacture effectiveness of the biochips is substantially improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of printing droplets using capillary electric charge concentration, the method comprising:

providing a capillary nozzle comprising a back-end part and a front-end part disposed substantially opposite the back-end part;

spacing a target member apart from the front-end part of the capillary nozzle at a predetermined distance;

immersing the back-end part in a solution; and supplying a voltage to the solution, wherein the back-end part transmits the solution to the front-end part.

2. The method of claim 1, wherein the capillary nozzle is disposed in a substantially vertical direction with respect to the solution.

3. The method of claim 1, further comprising supplying the voltage to the capillary nozzle.

4. The method of claim 1, further comprising supplying the voltage to the solution comprises disposing an electrode in the solution.

5. The method of claim 1, wherein the back-end part transmits the solution to the front-end part through a capillary force.

6. A method of printing droplets, the method comprising:

providing a capillary nozzle comprising a back-end part and a front-end part disposed substantially opposite the back-end part;

spacing a target member apart from the front-end part of the capillary nozzle at a predetermined distance;

immersing the back-end part in a solution;

forming a liquid bridge between the target member and the front-end part by supplying a voltage to the solution; and moving the target member away from the front-end part at a predetermined velocity, wherein the back-end part transmits the solution to the front-end part.

7. The method of claim 6, wherein the voltage comprises a sinusoidal voltage pulse.

8. The method of claim 6, wherein the liquid bridge is formed by electric induction.

9. The method of claim 6, wherein the predetermined distance is from about 50 micrometers to about 150 micrometers.

10. The method of claim 9, wherein the predetermined distance is about 100 micrometers.

11. The method of claim 6, wherein the predetermined velocity is from about 0.5 millimeters per second to about 3.0 millimeters per second.

12. The method of claim 11, wherein the predetermined velocity is about 1.75 millimeters per second.

* * * * *